United States Patent [19]

Carlson

[11] 4,033,860

[45] July 5, 1977

[54] MERCAPTAN CONVERSION PROCESS

[75] Inventor: David H. J. Carlson, Park Ridge, Ill.

[73] Assignee: UOP Inc., Des Plaines, Ill.

[22] Filed: Sept. 10, 1975

[21] Appl. No.: 612,618

[52] U.S. Cl. ..... 208/206; 208/207

[51] Int. Cl.[2] ..... C10G 19/00

[58] Field of Search ..... 208/182, 183, 206, 207

[56] References Cited

UNITED STATES PATENTS

| | | | |
|---|---|---|---|
| 947,503 | 1/1910 | Utley | 252/420 |
| 1,484,167 | 2/1924 | Allien | 208/182 |
| 1,556,396 | 10/1925 | Allien | 208/182 |
| 1,747,161 | 2/1930 | Clark | 208/183 |
| 2,794,767 | 6/1957 | Gleim et al. | 423/183 |
| 3,192,152 | 6/1965 | Maze et al. | 208/207 |
| 3,230,180 | 1/1966 | Larson | 208/207 |
| 3,371,031 | 2/1968 | Strong | 208/206 |
| 3,408,287 | 10/1968 | Urban et al. | 208/207 |

FOREIGN PATENTS OR APPLICATIONS

| | | | |
|---|---|---|---|
| 317,017 | 6/1930 | United Kingdom | 252/420 |

*Primary Examiner*—O. R. Vertiz
*Assistant Examiner*—Wayne A. Langel
*Attorney, Agent, or Firm*—James R. Hoatson, Jr.; Kimbley L. Muller; William H. Page, II

[57] ABSTRACT

A process is disclosed for the conversion of mercaptan compounds in a petroleum distillate which comprises contacting the petroleum distillate with caustic possessing a pH of from about 8 to a pH of about 10 to extract naphthenic acids, passing the naphthenic acid-free petroleum distillate to a charcoal bed to extract catalyst-toxin precursors and treating the resultant substantially toxin-precursor free petroleum distillate with an oxygen-containing gas atmosphere in the presence of a catalyst comprising a metal phthalocyanine compound dispersed on a solid support in a treatment medium possessing a pH of from about 9 to a pH of about 14.

17 Claims, 1 Drawing Figure

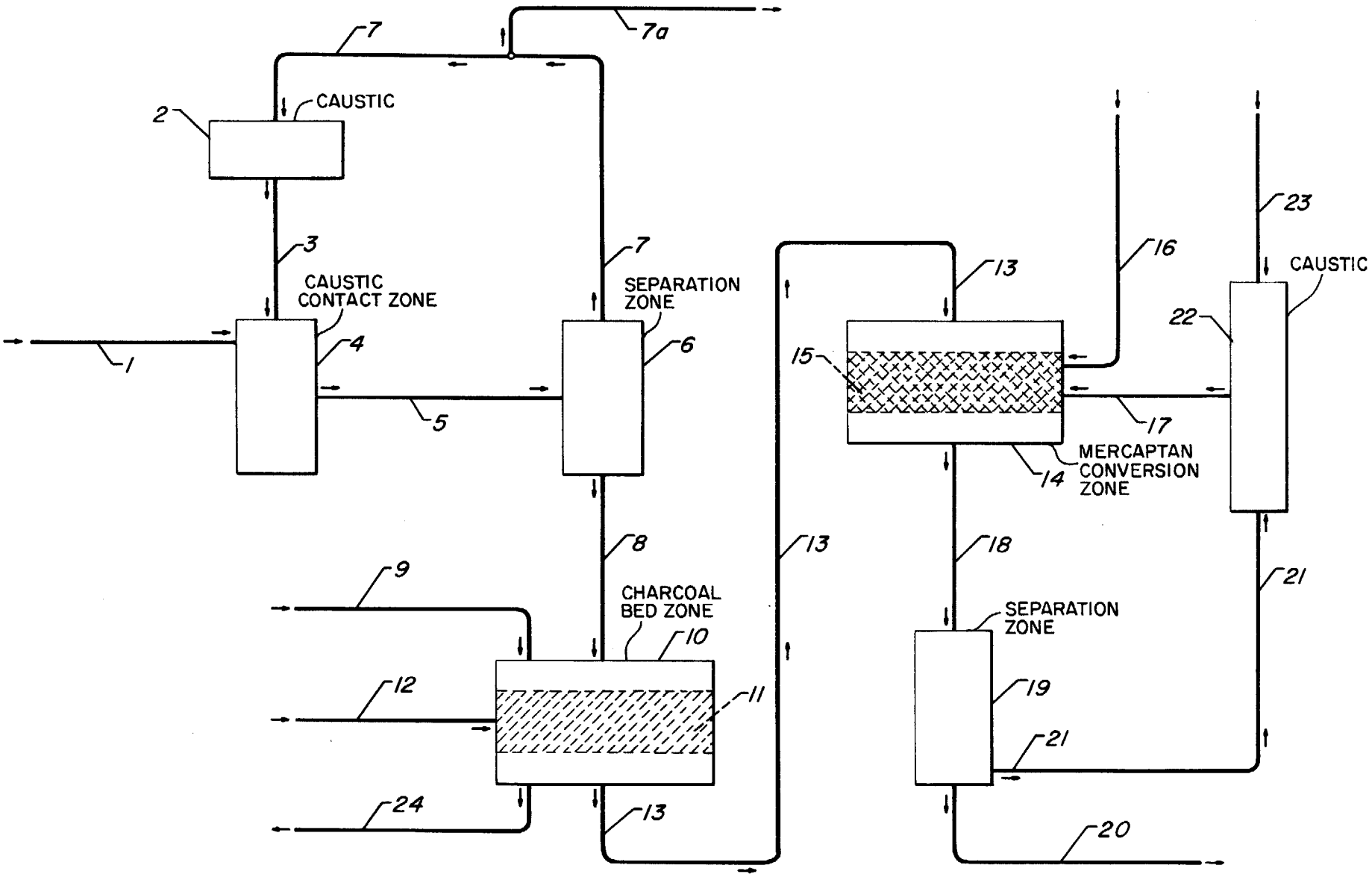
CAUSTIC
23
21
22
16
17
MERCAPTAN CONVERSION ZONE
14
SEPARATION ZONE
19
21
20
13
18
15
13
11
SEPARATION ZONE
6
CHARCOAL BED ZONE
10
7a
7
8
13
5
9
12
24
7
CAUSTIC
CAUSTIC CONTACT ZONE
4
3
2
1

MERCAPTAN CONVERSION PROCESS

This invention relates to a process for the conversion of mercaptan compounds. More specifically, this invention relates to a process for the conversion of mercaptan compounds contained in a petroleum distillate which comprises contacting the petroleum distillate with a caustic possessing a pH of about 8 to a pH of about 10 to extract naphthenic acids at contacting conditions, passing at least a portion of the substantially naphthenic acid-free petroleum distillate through a charcoal bed to extract catalyst-toxin precursors at passage conditions, and treating at least a portion of the substantially toxin precurso free petroleum distillate with an oxygen-containing gas in the presence of a catalyst comprising a metal phthalocyanine compound dispersed on a solid support in a treatment medium possessing a pH of about 9 to a pH of about 14 at treatment conditions.

The treatment of a petroleum distillate containing mercaptans for the conversion of said mercaptan compounds to disulfide compounds is well known in the prior art. The prior art has shown that various metal phthalocyanine compounds may be utilized for the oxidation of the mercaptan compounds to disulfide compounds in the presence of air. Further, it is known that the metal phthalocyanine compounds may be present in either a liquid-liquid wet system or may be present in a solid fixed bed system by an impregnation of the metal phthalocyanine compounds upon a solid support. It is also known in the prior art that the solid fixed bed treating unit requires the presence of an oxidation medium comprising a caustic material of a pH of from about 9 to a pH of about 14. It is also known through various refinery experiences that the solid fixed bed mercaptan treating units require regeneration at various intervals depending upon accumulated toxin materials dispersed upon the solid support which inhibit proper contact of the mercaptan-containing compounds in the petroleum distillate with the metal phthalocyanine compounds. It is also known that caustic utilized in the solid fixed bed mercaptan treating procedures will become spent or unusable without subsequent treatment of the caustic as a result of toxin-containing materials derived from the passage of said caustic over the fixed bed. The deposit of toxin materials upon the fixed bed is found at least partially to be the result of accumulation of oxidation of materials other than mercaptan compounds in the petroleum distillate. Therefore, it would be extremely advantageous to the treatment art to find a method to extract potential toxin compounds formed from the oxidation of various non-mercaptan compounds found in the petroleum distillate. The necessity to remove the toxin-containing precursor from the petroleum distillate will, of course, vary with the consistency of the mercaptan compounds and toxin precursor materials found within the petroleum distillate. The resulting advantage of the eradication of the toxin precursors will be to allow the fixed bed manufacture of mercaptan-free petroleum distillates a continuous treatment process without the necessity for any intermittent regeneration of the charcoal bed or any subsequent caustic regeneration processes of the toxin-containing caustic material. The process of this invention will also result in an advantage to the manufacturer or refiner of petroleum products as a result of the removal of these potential oxidation-resulting impurities in other refinery procedures such as the avoidance of the formation of elemental sulfur in various crude distillation units.

The process of the present invention comprises a process for the removal of harmful toxin-containing precursors from the petroleum distillate and the subsequent oxidation of the mercaptan-containing compounds without the formation of toxin-containing materials on the solid fixed bed metal phthalocyanine impregnated support by the contacting of the petroleum distillate with a caustic possessing from a pH of from about 8 to a pH of about 10 to extract naphthenic acids at contacting conditions and passage of the naphthenic acid-free petroleum distillate through a charcoal bed to extract catalyst-toxin precursors at passage conditions before passage of the petroleum distillate to a solid bed treating unit for the conversion of the mercaptan-containing compounds to disulfide compounds in the presence of an oxygen-containing gas atmosphere and a catalyst comprising a metal phthalocyanine catalyst dispersed on a solid support in a treatment medium possessing a pH of from about 9 to a pH of about 14.

The utilization of the present invention resides in the ability of the solid bed mercaptan conversion unit to perform the continuous mercaptan compound oxidation to disulfide compounds in a petroleum distillate in a continual and uninterrupted manner without the necessity for regeneration of either the fixed-bed treating unit or the caustic medium utilized in the solid fixed bed.

It is an object of this invention to provide a process for the conversion of mercaptan-containing compounds.

It is also an object of this invention to provide a process for the conversion of mercaptan-containing compounds in a more pecuniarily rewarding manner.

In one aspect an embodiment of this invention resides in a process for the conversion of mercaptan compounds contained in a petroleum distillate which comprises contacting said petroleum distillate with a caustic possessing a pH of from about 8 to a pH of about 10 to extract naphthenic acids at contacting conditions and recovering the resultant substantially naphthenic acid-free petroleum distillate, passing at least a portion of the substantially naphthenic acid-free petroleum distillate to a charcoal bed to extract catalyst-toxin precursors at passage conditions and recovering the substantially toxin-precursor free petroleum distillate, treating at least a portion of the substantially toxin-precursor free petroleum distillate with an oxygen-containing gas atmosphere in the presence of a catalyst comprising a metal phthalocyanine dispersed on a solid support in a treatment medium possessing a pH of from about 9 to a pH of about 14 at treatment conditions and recovering the resultant substantially mercaptan-free petroleum distillate.

A specific embodiment of this invention resides in the treatment of a kerosine petroleum distillate which comprises contacting the kerosine petroleum distillate with sodium hydroxide possessing a pH of about 9 to extract naphthenic acids, passing at least a portion of the substantially naphthenic acid-free petroleum distillate through a charcoal bed derived from lignite charcoal to extract catalyst-toxin precursors and treating at least a portion of the resultant recovered petroleum distillate which is substantially free of toxin-precursors in the presence of air and cobalt phthalocyanine dispersed on a lignite charcoal support in a treatment medium comprising sodium hydroxide possessing a pH of about 14 and recovering the resultant substantially mercaptan-free kerosine petroleum distillate.

Another specific embodiment of this invention resides in a process for the conversion of mercaptan-containing compounds found in a gasoline petroleum distillate which comprises contacting said gasoline petroleum distillate with potassium hydroxide possessing a pH of about 8 to extract naphthenic acids at a temperature of about 50° C. and a pressure of about 1 atmosphere, passing at least a portion of the substantially naphthenic acid-free gasoline petroleum distillate through a charcoal bed derived from vegetable sources at a liquid hourly space velocity of 0.9 and a temperature of 50° C. and a pressure of 1 atmosphere, treating at least a portion of the substantially free toxin-precursor gasoline petroleum distillate with oxygen in the presence of a cobalt phthalocyanine compound dispersed on a $\gamma$-alumina support in the presence of a treatment medium possessing sodium hydroxide possessing a pH of about 14 at a temperature of about 75° C., a pressure of about 5 atmospheres as afforded by the introduction of the oxygen-containing gas and a liquid hourly space velocity of 1.0 and recovering the resultant substantially mercaptan-free gasoline petroleum distillate.

Other objects and embodiments of the above set forth invention will be discussed in further detail and explained in conjunction with the attached drawing.

The Drawing shows a general flow scheme employed in the process of the invention.

As hereinbefore set forth the present invention is concerned with a process for the conversion of mercaptan-containing compounds in a petroleum distillate to disulfide compounds which comprises contacting said petroleum distillate with a caustic possessing a pH of from about 8 to a pH of about 10 to extract naphthenic acid at contacting conditions and recovering the resultant substantially naphthenic acid-free petroleum distillate. The contacting conditions of the present invention may be defined to include a temperature of from about 10° C. to about 100° C. and a pressure of from about 1 atmosphere to about 100 atmospheres. The resultant substantially naphthenic acid-free petroleum distillate is then passed through a charcoal bed to extract catalyst-toxin precursors at passage conditions and recovering the resultant substantially toxin-precursor free petroleum distillate. The passage conditions of the present invention will comprise from about 10° C. to about 100° C., a pressure of from about 1 atmosphere to about 100 atmospheres and a liquid hourly space velocity of from about 0.5 to about 10. It should be noted that the petroleum distillate may be first passed through the charcoal bed and subsequently contacted with the dilute caustic medium for naphthenic acid removal, however, this change in procedures of the above set forth invention will not necessarily give exactly the same toxin-precursor free and naphthenic acid-free-petroleum distillate for subsequent charge to the mercaptan treating unit. The mercaptan compounds are treated with an oxygen-containing gas atmosphere in the presence of a catalyst comprising a metal phthalocyanine compound dispersed on a solid support in a treatment medium possessing a pH of from about 9 to a pH of about 14 at treatment conditions. The treatment conditions of the present invention include a temperature of about 10° C. to about 100° C., a pressure of from about 1 atmosphere to about 100 atmospheres and a liquid hourly space velocity of from about 0.5 to about 10. The superatmospheric pressures which may be afforded in steps (a) and (b) of the principal appended claim of the present invention may be afforded by the introduction to the reaction zone of any substantially inert gas such as nitrogen, helium, argon, krypton, xenon, or mixtures of these various inert gases such as nitrogen-helium, nitrogen-argon, nitrogen-krypton, argon-helium, kyrpton-xenon, neon-nitrogen, etc. The excess pressure in step (c) of the present invention may be afforded by the introduction to the reaction zone of the oxygen-containing gas atmosphere or the excess pressure may only be partially afforded by the presence of the oxygen-containing gas atmosphere and the remaining excess pressure may be afforded by any of the aforementioned inert gas or inert gas mixtures, whereby the total pressure of the mercaptan compound conversion stage will equal the partial pressure of the oxygen-containing gas atmosphere plus the partial pressure of any inert gas charged with the oxygen-containing gas atmosphere. For instance, air may be used as an example to show the charge of oxygen with nitrogen to increase the pressure in the solid bed treating unit stage of the present invention from atmospheric pressure to superatmospheric pressure. The liquid hourly space velocity of the present invention set forth in steps (b) and (c) of the principal claim may be defined to be the volume rate of liquid charged to the charcoal bed or metal phthalocyanine impregnated charcoal bed zone per cubic volume of the absorbent or solid bed compound. It is also contemplated within the scope of this invention that the passage of the materials over the charcoal bed and the metal phthalocyanine impregnated solid support may be performed in a downflow gravitational method or the passage over the various beds may be performed by the percolation of the liquids over the various beds by the sporadic charge to the bed units of a stream of inert gas such as nitrogen or the non-continuous charging of a nitrogen carrier agent to the bed.

The petroleum distillate of the present invention will comprise any petroleum distillate extracted from various crude oils, earth oils, Lima oils, Seneca oils, rock oils, natural gas, ligroin, gasoline, including thermally cracked and FCC cracked gasoline, naphtha, kerosine, fuel oils, gas oils, lubricating oils, paraffin wax, road oils, asphalts, coke, etc. The only requirements of the petroleum distillate is that it contains a suitable amount of mercaptan material to treat for conversion to the desired disulfide material. The quantity of mercaptan material necessary within the petroleum distillate will range from about 5 ppm of mercaptans for light weight petroleum distillates such as natural gas to about 20 ppm mercaptans for heavier petroleum distillates such as kerosine.

The mercaptan-containing compounds within the petroleum distillate will comprise both alkyl and aromatic mercaptans which may be exemplified by alkyl mercaptans possessing from about 1 carbon atom to about 19 carbon atoms or various aromatic mercaptans such as thiophenols or substituted thiophenols. The various mercaptan compounds may be exemplified by such mercaptans as methyl mercaptan, ethyl mercaptan, propyl mercaptans, butyl mercaptans, pentyl mercaptans, hexyl mercaptans, heptyl mercaptans, octyl mercaptans, nonyl mercaptans, decyl mercaptans, t-dodecyl mercaptans, undecyl mercaptans, dodecyl mercaptans, tridecyl mercaptans, tetradecyl mercaptans, pentadecyl mercaptans, hexadecyl mercaptans, heptadecyl mercaptans, octadecyl mercaptans, nonadecyl mercaptans, various mercaptobenzothiazoles, hydroxy mercaptans such as mercapto-ethanol, cysteine, etc., or aromatic mercaptans such as thiophenol, methyl-substituted thiophenol isomers, ethyl-substituted thiophenol isomers, propyl-substituted thiophenol isomers, etc.

The catalytic composition of matter of the present invention utilized in step (c) of the mercaptan oxidation procedure will comprise a metal phthalocyanine compound dispersed on a solid support. The preferred catalytic composition of the present invention will include a Group VIII metal phthalocyanine compound selected from the Periodic Table present in the entire treatment system in a weight percent of from about 0.0001 weight percent to about 10.0 weight percent. Suitable examples of Group VIII metal phthalocyanine would include carboxylated and sulfonated cobalt phthalocyanine, iron phthalocyanine, nickel phthalocyanine, palladium phthalocyanine, rhodium phthalocyanine, ruthenium phthalocyanine, osmium phthalocyanine, iridium phthalocyanine, platinum phthalocyanine, or mixtures thereof, etc. Other sulfonated or carboxylated metal phthalocyanines such as vanadium, chromium, manganese, technetium, rehenium, tungsten or tatalum may also be utilized, although not necessarily with equivalent results. The mercaptan compound is oxidized in the presence of a solid fixed bed which comprises a solid support such as an alumina, silica, thallia, zirconia, pumice, mordenite, stilbite, faujasite, thomsonite, heulandite, natrolite, chabazite, analcite, bone char charcoal, charcoal derived from vegetable sources, lignite or bituminous coal derived charcoal or charcoal derived from petroleum extrusions, etc.

The process of the present invention will utilize a caustic compound in both step (a) and step (c) of the principal claim. In step (a) the caustic may be diluted with water or any other suitable diluent to produce a pH of about 8 to about a pH of 10 and the caustic in step (c) may be used in a range of from about a pH of about 9 to a pH of about 14. Suitable examples of caustics which may be utilized as contacting agents or treating mediums will include sodium hydroxide, potassium hydroxide, lithium hydroxide, rubidium hydroxide, cesium hydroxide, barium hydroxide, strontium hydroxide, calcium hydroxide, manganese hydroxide, beryllium hydroxide, ammonium hydroxide, pyridene, piperidine, picoline, lutidine, quinoline, pyrrole, indole, carbozole, acridine, or any suitable quaternary ammonia compounds such as tetrabutylammonium hydroxide, tetraamylammonium hydroxide, tetrapropylammonium methoxide, tetraamylammonium methoxide, tetraethylammonium ethoxide, diethylamine, triethylamine, tetramethylenediamine, tetraethylenepentamine, phenylenediamine, etc.

The charcoal bed utilized in step (b) of the principal claim will comprise any suitable charcoal-containing solid bed. A preferred embodiment of the present invention will comprise charcoal which is derived from lignite coal, bituminous coal or vegetable sources. It has been found that suitable charcoals may be exemplified by Nuchar charcoals, which may be purchased from Westvaco Company, which is a charcoal that is derived from vegetable sources such as ground wood pulp, Hydrodarco, which may be purchased from the Atlas Chemical Company and is derived from lignite coal, Norit charcoals, which may be purchased from the Norit Company, which is a charcoal derived from peat, Columbia charcoal which is a special charcoal derived from petroleum black via an extrusion process and may be purchased from Union Carbide Company, Pittsburgh charcoal which is derived from bituminous coal and may be purchased from the Calgon Company or any other similar charcoals derived from lignite coal, bituminous coal, vegetable sources, peat or petroleum black extrusions.

It is understood that the aforementioned petroleum distillates, inert gases, mercaptan compounds, metal phthalocyanine compounds, solid supports and caustic compounds are only representative of the class of compound which may be utilized in the present invention and that the present invention is not necessarily limited thereto.

Referring now to the attached drawing, the present invention is exemplified as a general flow scheme employed without intent to give details about heaters, condensors, pumps, compressors, valves, process control equipment, etc. In the attached drawing, the petroleum distillate is charged through line 1 to contacting vessel 4. The petroleum distillate is contacted with a dilute caustic possessing a pH of from about 8 to about 10, said dilute caustic being charged to contacting zone 4 through line 3. Line 3 is attached to the dilute caustic reservoir 2 which may contain either fresh dilute caustic or the caustic may be recirculated by means of separation from the petroleum distillate in separation zone 6 and recycling of the dilute caustic to dilute caustic reservoir 2 by means of line 7. The solution or mixture within contacting zone 4 is mixed at high or low shear speeds by a mixing means within the contacting vessel 4 and removed from contacting vessel 4 through line 5 and charged to separation zone 6. Separation zone 6 acts to separate the petroleum distillate from the dilute caustic so that the dilute caustic may be recycled to dilute caustic reservoir 2 through line 7 or the dilute caustic which has become spent may be exited from the flow scheme through line **7*a*. The petroleum distillate which is substantially naphthenic acid-free by means of the previous dilute caustic contacting is separated in separation zone 6 and egressed therefrom through line 8. Line 8 possessing the substantially naphthenic acid-free petroleum distillate is entered into charcoal bed zone 10 which contains a charcoal bed 11. The petroleum distillate may be entered to the bed in a gravitational downflow method or the petroleum distillate may be percolated through charcoal bed zone 10 and charcoal bed 11 by means of the continual or intermittent charge of an inert gas from line 9 to the charcoal bed zone 10 thereby creating a percolation of the petroleum distillate through the bed. It is contemplated within the scope of this invention that the charcoal bed 11 will absorb toxin precursors from the petroleum distillate. The charcoal bed 11 may become spent or saturated with the toxin precursors and thereby necessitate regeneration of the charcoal. The regeneration may be effected by the treatment of steam at a temperature of 450° C. to 520° C. by means of entry of steam through line 12. The condensate may be removed by any method known to the art through line 13 or the condensate may be exited from the process flow through line 24. The precursor- and naphthenic acid-free petroleum distillate is withdrawn from charcoal bed zone 10 through line 13 and charged to treatment zone 14 possessing a solid support 15 which has a metal phthalocyanine catalyst impregnated on the solid support. The treatment of the mercaptan-containing compounds in the petroleum distillate is effected as the petroleum distillate passes over the impregnated solid support in the presence of air or oxygen which is entered to the treatment zone through line 16. After passage over the catalyst bed 15, the petroleum distillate is substantially mercaptan-free as a result of the conversion of the mercaptan compounds to disulfide compounds. The treatment of the mercaptan compounds is effected in the presence of a medium comprising a pH of from about a pH of 9 to about a pH of 14. The caustic may be charged to the reaction zone through line 17 which is attached to caustic reservoir 22 containing caustic which may be either fresh caustic charged through line 23 or recycled caustic through line 21. The substantially mercaptan-free petroleum distillate egresses from treatment zone 14 through line 18 and is charged to separation zone 19. In separation zone 19 the substantially mercaptan-free petroleum distillate is separated from any caustic material present and the substantially mercaptan-free and cuastic-free petroleum distillate is egressed from the process flow through line 20 for use in other refinery processes while any recovered useable caustic material is returned to the custic reservoir 22 through line 21. It should be noted that the present invention will extract naphthenic compounds and toxin precursor compounds from the petroleum distillate and preserve the metal phthalocyanine impregnated charcoal bed 15 from contamination, and therefore, eliminate any regeneration technique necessary to clean the charcoal bed or caustic medium within lines 21 and 17 and caustic reservoir 22**.

It should be noted in the process of the present invention that the charcoal bed in step (b) may become saturated or spent as a result of the accumulation of catalyst-toxin precursors on the charcoal bed as a result of the continuous passage of the petroleum distillate. It is contemplated within the scope of this invention that multiple charcoal beds may be present in series or parallel, so that one charcoal bed may be activated for toxin removal while a second is being regenerated. The regeneration of the charcoal bed is effected by steam treatment of the bed to extract the accumulated toxin precursor materials. The steam treating for regeneration of the charcoal bed is effected at a temperature of about 425° C. to about 520° C. and a pressure of from about 1 atmosphere to about 100 atmospheres.

The following examples are given to illustrate the process of the present invention which, however, are not intended to limit the generally broad scope of the present invention in strict accordance therewith.

EXAMPLE I

In this example a petroleum distillate kerosine was utilized which contained a mercaptan sulfur content of 434 ppm and was found to repeatedly deposit accumulations of toxin materials on a fixed bed treating unit and in the caustic medium of the mercaptan fixed bed treating unit. An analysis of the kerosine revealed the following physical characteristics set forth in Table I below:

TABLE I

| | |
|---|---|
| MERCAPTAN SULFUR | 434 ppm |
| HYDROGEN SULFIDE, SULFUR | <1 ppm |
| COPPER | 0.021 mg/liter |
| [1]ACID NUMBER | 0.004 mg KOH/gram |
| [2]SAYBOLT COLOR | 30 |
| API GR | 42.9 |
| SP GR | 0.8114 |
| DISTILLATION | |
| IBP ° F. | 356 |
| 10 | 369 |
| 30 | 385 |
| 50 | 404 |
| 70 | 428 |
| 90 | 463 |
| 95 | 477 |
| EP ° F. | 490 |

[1]ACID NUMBER is determined by titration with potassium hydroxide.
[2]SAYBOLT COLOR is measured after 20 hour acceleration.

The aforementioned kerosine was treated in a beaker in the presence of oxygen, sodium hydroxide possessing a pH of 14 and a catalyst comprising cobalt phthalocyanine monosulfonate dispersed on a 12 × 30 Hydrodarco charcoal to the (HYDRODARCO was purchased from the Atlas Chemical Division, Wilmington, Del.) quantity of 150 mg of the metal phthalocyanine compound per 100 cc of the charcoal. The 12 × 30 Hydrodarco charcoal was determined to have the physical properties set forth in Table II below:

TABLE II

| | |
|---|---|
| SURFACE AREA | 600 $m^2/g$ |
| DENSITY | 0.40–0.45 g/cc |
| BED DENSITY | 235 $lbs/ft^3$ |
| SIEVE ANALYSIS | |
| % RETAINED on No. 12 SIEVE | 5 |
| % RETAINED on No. 30 SIEVE | 5 |
| UNIFORMITY COEFFICIENT | 1.7 or less |
| ABRASION % RETENTION | 75 min. |
| ASH CONTENT | 17% |
| MOISTURE CONTENT | 6% |

The kerosine was shaken with the catalyst, sodium hydroxide and air at ambient temperature and pressure for a period of time comprising 120 minutes, during which samples were extracted and analyzed for mercaptan content, said analysis being set forth in Table III below:

TABLE III

| TIME OF SAMPLE EXTRACTION | PPM MERCAPTAN IN KEROSINE |
|---|---|
| 0 | 434 |
| 10 | 30 |
| 20 | 19 |
| 30 | 9 |
| 60 | 3 |
| 90 | 1 |
| 120 | 1 |

EXAMPLE II

In this example the kerosine charge stock was contacted with dilute sodium hydroxide to extract the naphthenic acids therefrom. The kerosine possessed the following physical properties set forth in Table IV below subsequent to the prewash treatment.

TABLE IV

| | |
|---|---|
| MERCAPTAN SULFUR | 388 ppm |
| HYDROGEN SULFIDE, SULFUR | <1 ppm |
| COPPER | 0.021 mg/liter |
| [4]ACID NUMBER | 0.001 mg KOH/gram |
| [5]SAYBOLT COLOR | 30.0 |
| API GR | 42.9 |
| SP GR | 0.8114 |
| DISTILLATION | |
| IBP ° F. | 349 |
| 5 | 364 |
| 10 | 368 |
| 30 | 384 |
| 50 | 404 |

TABLE IV-continued

| | |
|---|---|
| 70 | 425 |
| 90 | 456 |
| 95 | 470 |
| EP ° F. | 490 |

[4]ACID NUMBER was determined by the same method as utilized in Table I.
[5]SAYBOLT COLOR was measured by the same method as utilized in Table I.

The dilute caustic treated kerosine of Table IV was shaken in a beaker at ambient temperature and pressure with air, cobalt phthalocyanine monosulfonate and sodium hydroxide possessing a pH of 14 in the same proportions as set forth in Example I above, the results of the shake test being set forth in Table V below:

TABLE V

| TIME OF SAMPLE EXTRACTION | PPM MERCAPTAN IN KEROSINE |
|---|---|
| 0 | 388 |
| 10 | — |
| 20 | — |
| 30 | — |
| 60 | 4 |
| 90 | 1.4 |
| 120 | 1.3 |

It can be seen by a comparison of Examples I and II that the naphthenic acid removal produced a less troublesome kerosine distillate to treat for mercaptan conversion, however, the novelty of this invention can only be seen by a comparison of Examples I and II with the following Example III.

EXAMPLE III

In this example the naphthenic acid-free kerosine was percolated in a downflow gravitational method at a LHSV of 1.0 through an unimpregnated Hydrodarco charcoal similar to that set forth in Example I. The percolated product was recovered and found to contain 153 ppm mercaptan and to be substantially toxin-precursor-free. The decrease in mercaptan content was believed the result of the oxidation of the mercaptan compounds with entrained oxygen within the petroleum kerosine distillate. The recovered percolated kerosine was found to be toxin-precursor-free by utilizing the same experimental procedure and analysis as set forth in Example I and II above. The following Table VI contains the results of the analysis of mercaptan-content samples during the same time intervals of Example I and II:

TABLE VI

| TIME OF SAMPLE EXTRACTION | PPM MERCAPTAN IN KEROSINE |
|---|---|
| 0 | 153 |
| 10 | 5 |
| 20 | 1.6 |
| 30 | — |
| 60 | — |
| 90 | — |
| 120 | — |

The novelty of this invention may be exemplified by a comparison of Examples I and II with Example III.

In Example I, Table III sets forth the time required for mercaptan oxidation utilizing neither prewash step (a) or charcoal bed passage step (b) of the appended principal claim. The mercaptan content after 20 minutes of treating was 19 ppm and 9 ppm after 30 minutes. After the dilute caustic treatment of the kerosine, the results of Example II shown the mercaptan level to be 13 ppm at 30 minutes. The dilute caustic wash would not appear to have augmented mercaptan conversion, however, it was found that the removal of naphthenic acids was necessary to establish the low mercaptan levels of the Example III. The results disclosed in Table VI demonstrate the novelty of the present invention. The mercaptan content was found to be 5 ppm at 10 minutes and 1.6 ppm at 20 minutes utilizing the charcoal bed treatment of the substantially naphthenic acid-free kerosine. In direct comparison with the untreated kerosine, the mercaptan quantity in ppm was 25 ppm less at 10 minutes and 17.4 ppm less at 20 minutes when the process set forth in the principal appended claim was used to treat the petroleum distillate before actual conversion of the mercaptan compounds. Further, the solid catalytic impregnated bed of Example III was found to contain no toxin materials and no evidence of eventual naphthenic acid accumulation. The charcoal bed used to absorb the toxin materials was found to contain various heavy molecular weight toxin compounds which were readily removed from the pretreatment bed by steam cleaning at 450° C. for 3 hours at a steam rate of 1 mole of water/hour.

EXAMPLE IV

In this example the experiment of Example III is performed with the following substitutions of parameters. Potassium hydroxide is substituted for all sodium hydroxide, the charcoal is one derived from vegetable sources, the catalyst is vanadium phthalocyanine disulfonate dispersed on γ-alumina and the petroleum distillate is a mercaptan-containing FCC gasoline. The results of Example III are found to be repeated within the generic disclosure of the present invention.

I claim as my invention:

1. In a process for the reduction of mercaptan compounds in a petroleum distillate which comprises contacting said petroleum distillate with a caustic possessing a pH of from about 8 to a pH of about 10 to extract naphthenic acids at a temperature of about 10° C to about 100° C and a pressure of from about 1 atmosphere to about 100 atmospheres and catalytically treating said petroleum distillate with an oxygen-containing gas atmosphere in the presence of a catalyst consisting essentially of a metal phthalocyanine compound dispersed on a solid catalytic support in a caustic medium possessing a pH of from about 9 to a pH of about 14 at a temperature of from about 10° C to about 100° C, a pressure of from about 1 atmosphere to about 100 atmospheres and a liquid hourly space velocity of from about 0.5 to about 10 to substantially reduce mercaptan content of said petroleum distillate the improvement which consists of passing said petroleum distillate subsequent to contacting with said caustic and before catalytic treatment thereof through an unimpregnated charcoal bed selected from the group consisting of a charcoal derived from lignite coal, bituminous coal, vegetable sources, peat, petroleum black extrusions and bone char to remove catalyst-toxin precursors from said distillate at a temperature of from about 10° C to about 100° C, a pressure of from about 1 atmosphere to about 10 atmospheres and a liquid hourly space velocity of from about 0.5 to about 10.

2. The process of claim 1 further characterized in that the mercaptan compound is an alkyl mercaptan.

3. The process of claim 2 further characterized in that the alkyl mercaptan compound is methyl mercaptan.

4. The process of claim 2 further characterized in that the alkyl mercaptan compound is t-dodecyl mercaptan.

5. The process of claim 1 further characterized in that the mercaptan compound is an aromatic mercaptan.

6. The process of claim 5 further characterized in that the aromatic mercaptan is thiophenol.

7. The process of claim 1 further characterized in that the petroleum distillate is gasoline.

8. The process of claim 1 further characterized in that the petroleum distillate is kerosine.

9. The process of claim 1 further characterized in that the contacting caustic is sodium hydroxide.

10. The process of claim 1 further characterized in that the contacting caustic is potassium hydroxide.

11. The process of claim 1 further characterized in that the caustic medium is sodium hydroxide.

12. The process of claim 1 further characterized in that the caustic medium is potassium hydroxide.

13. The process of claim 1 further characterized in that the caustic medium is calcium hydroxide.

14. The process of claim 1 further characterized in that the metal phthalocyanine compound dispersed on a solid support is cobalt phthalocyanine dispersed on charcoal.

15. The process of claim 1 further characterized in that the metal phthalocyanine compound dispersed on a solid support is cobalt phthalocyanine dispersed on $\gamma$-alumina.

16. The process of claim 1 further characterized in that the metal phthalocyanine compound dispersed on a solid support is vanadium phthalocyanine dispersed on $\gamma$-alumina.

17. The process of claim 1 further characterized in that said charcoal bed is regenerated by treatment with steam at a temperature of from about 400° C. to about 530° C. and a pressure of from about 1 atmosphere to about 100 atmospheres.

* * * * *